US005709384A

United States Patent [19]

Miller

[11] Patent Number: 5,709,384

[45] Date of Patent: Jan. 20, 1998

[54] BOARD GAME

[76] Inventor: Frederick Miller, Rt. No. 02 Box 1577A, Lancaster, Va. 22503

[21] Appl. No.: 613,187

[22] Filed: Mar. 8, 1996

[51] Int. Cl.[6] ..... A63F 3/00

[52] U.S. Cl. ..... 273/256; 273/244.2; 273/249

[58] Field of Search ..... 273/241, 242, 273/248, 256, 278, 243, 249

[56] References Cited

U.S. PATENT DOCUMENTS

| | | | |
|---|---|---|---|
| 2,139,493 | 12/1938 | Field | 273/248 |
| 4,223,892 | 9/1980 | Matherne | 273/248 |
| 4,477,080 | 10/1984 | Baker | 273/241 |
| 4,852,886 | 8/1989 | Zaruba | 273/242 |

FOREIGN PATENT DOCUMENTS

| | | | |
|---|---|---|---|
| 2187968 | 9/1987 | United Kingdom | 273/242 |

*Primary Examiner*—Benjamin H. Layno
*Assistant Examiner*—Stephen L. Blau
*Attorney, Agent, or Firm*—Scott B. Garrison; Gary E. Lambert

[57] ABSTRACT

A game apparatus having a game board divided into a grid pattern. Playing paths are arranged to allow player tokens to progress along bordering grid squares in a predesignated manner until player's token enters a center area. Players are rewarded and penalized by landing on grid squares or drawing cards resulting in gain or loss of play money. Additional territorial areas are set aside on the game board providing players with the opportunity to further penalize other players for landing therein. The purpose of the game is to accumulate and maintain the most wealth by game's end.

6 Claims, 22 Drawing Sheets

I'M BACK!

RETURN CARD
WORTH $35,000 FOR FINAL COUNT,
ISSUED (BY CLERK) UPON A PLAYER START BOX RETURN, WHEN THE PLAYER DISPLAYS A TREASURY CARD.
IF A PLAYER ENTERED ONE TOKEN INTO THE TREASURY TWICE, THE EXTRA CARD CAN BE USED BY THE OTHER TOKEN IF THE PLAYER SO CHOOSES.

14

DOCTOR $$$$$

BILLING RIGHTS
PURCHASE PRICE - $40,000

FEE SCHEDULE
BILL TO OTHER PLAYERS

MD 1 = $250 FOR WAITING

MD 2 = $2,000 FOR NOT WAITING

MD 3 = $550 OFFICE VISIT

MD 4 = $20,000 FOR PERFORMING UNNECESSARY OPERATION

MD 5 = $15,000 FOR PERFORMING

CUE CARD
(THESE CUE CARDS ARE MEANT TO IDENTIFY THE BOARD SYMBOLS AND ASSIST DURING PLAY).

IF YOU LAND ON A PROFESSION:

"C" = CONSULTANT - IF NOT OWNED, YOU MAY BUY THE RIGHTS IF THE SQUARE IS MARKED WITH A NUMBER 1. IF OWNED PAY FEE. IF NOT OWNED AND OF ANOTHER NO. THAN 1, PAY THE BANK 1/10TH THE FEE.

RE = REAL ESTATE OWNER - " " " " " " " "

P = PROFESSOR - " " " " " " " "

B = BROKER - " " " " " " " "

MD = DOCTOR - " " " " " " " "

L = LAWYER - " ETC.

IC = INDIAN CHIEF - " ETC.

IF YOU BUY THE RIGHTS, OTHER PLAYERS LANDING ON YOUR SYMBOLS MUST PAY THE FULL FEE AS INDICATED BY THE SYMBOL NUMBER, AS LONG AS YOU OWN THE CARD ( THE CLERK ISSUES THE CARD TO YOU ).

IF YOU LAND ON SQUARES MARKED:

- = MINUS ( PENALTY ) PICK A TOP CARD FROM THE MINUS PILE.

+ = PLUS ( BONUS ) " " " " " " PLUS " .

= FOR THE BIRDS " " " " " " BIRD " .

I = INHERIT " " " " " " INHERIT " .

STOCKS, BONDS, ETC. = INVESTMENT " " " STOCKS, ETC

= MISC. " " " " " " MISC. " .

= UNKNOWN & OPTIONS " " " " " ? " .

( IF YOU CANNOT REACH THE PILE, THE CLERK WILL PASS YOU FACE DOWN THE TOP CARD ON THE BOTTOM FOLLOWING DIRECTIONS UNLESS OTHERWISE STATED ON CARD.)

FIG. 8

LANDING ON OTHER SQUARES MEAN:

= BANK - COLLECT $20,000

= MONEY - ROLL THE DICE AGAIN AND RECEIVE $2,000 PER DOT ON THE DICE ( IN OTHER WORDS $24,000 FOR THE HIGHEST POSSIBLE THROW AND $4,000 FOR THE LOWEST).

"E" = EXTRA ROLL OF DICE - THROW AND MOVE THE SAME TOKEN AGAIN.

"A" = ADVANCE - MOVE THE SAME TOKEN 3 MORE SQUARES (SEE WHAT HAPPENS).

"S" = SAFE - WHEN YOU ARE ON THIS SQUARE, GOVERNORS CANNOT STRIKE.

+ OR - X = TAKE FROM (+) OR PUT INTO (-) THE BANK THE DOLLARS LISTED ON THE SQUARES ( TIMES X ) THE DICE ROLL.
SOME OTHER SQUARES ARE MARKED AS TO THE PENALTY OR THE REWARD.

= ( SCOOT ) -

| | |
|---|---|
| MOVE TO / LAND ON | WHEN HEADING CLOCKWISE |
| LAND AND STAY | WHEN MOVING CLOCKWISE UNLESS YOU HAVE A DOUBLE, THEN MOVE ON. |
| LAND ON / MOVE TO | WHEN HEADING COUNTER-CLOCKWISE |
| LAND AND STAY | WHEN MOVING COUNTER-CLOCKWISE UNLESS YOU HAVE A DOUBLE, THEN MOVE ON. |

A

ON THE WAY UP TO THE TREASURY IF YOU LAND ON THIS SCOOT MOVE YOUR TOKEN UP AND THEN ADVANCE 3 MORE SQUARES. ON THE WAY BACK IF YOU LAND ON THE SCOOT WITH THE "A",YOU CAN MOVE DOWN THE SCOOT AND ADVANCE 3 MORE SQUARES OR YOU MAY CONTINUE ON THE SAME ROW AND ADVANCE 3 MORE SQUARES, WHICHEVER YOU LIKE.

SEE REVERSE SIDE

FIG. 9

TOTAL WEALTH
2,3 OR 4 PLAYERS
RULES

THE OBJECT OF TOTAL WEALTH IS TO END THE GAME WITH THE HIGHEST TOTAL WEALTH ( $ + ASSET VALUES ) FOR THE WIN.

EACH PLAYER CHOOSES THEIR COLOR TOKENS AND PLACES 2 OF THEM IN THE START BOX TOTAL WEALTH. A PLAYER MUST START FROM THIS CORNER BOX AND GET BOTH TOKENS TO THE TREASURY, MOVING CLOCKWISE FOLLOWING THE ROWS TURNING AT CORNERS AND ENTER THE TREASURY, COLLECT THE REWARD LISTED AND THEN RETURN BOTH TOKENS TO THE START BOX BY MOVING COUNTERCLOCKWISE AND DESCEND IN THE OPPOSITE MANNER. WHEN ALL PLAYERS HAVE RETURNED THEY COUNT THEIR CASH AND OTHER ASSETS TO DETERMINE THE WINNER.

YOU NOW PICK UP THE OTHER MATCHING COLOR 2 TOKENS AND PLACE ON EACH A BUST OF THE FIGURE CALLED GOVERNOR. THUS. YOUR GOVERNOR GOVERNS YOUR COLOR TERRITORIES UPPER AND LOWER. YOU AS THE GOVERNOR OF YOUR TERRITORIES PENALIZE YOUR OPPONENTS WITH YOUR GOVERNOR AS YOU WILL SEE LATER.

PLACE ONE IN THE UPPER TERRITORY ON GOV. AND ONE IN THE LOWER TERRITORY ON G.

SELECT A BANKER. THE BANKER GIVES EACH PLAYER $50, 115 DOLLARS AS A BEGINNING GRUBSTAKE. EACH PLAYER RECEIVES (1)$20,000 BILL (2) $10,000, (1) $5,000, (3) $1,000, (2) $500, (7) $100, (4) $50, (7) $20, (5) $10, (4) $5 AND (5) 1S (THE BANKER RECEIVES $15,000 EXTRA).

SELECT A CLERK OF ALL TERRITORIES. THE CLERK SHUFFLES AND PLACES THE VARIOUS PROPER CARDS IN STACKS FACE DOWN BY SYMBOLS. THE I.O.U. CARDS, BR CARDS AND CHIPS GO TO THE BANK. THE CLERK RECEIVES $5,000 EXTRA.

NOW EACH PLAYER IS ALLOWED TWO ROLLS OF THE DICE PER TURN AFTER THE SECOND TURN IS OVER. ON THE FIRST TURN A PLAYER ROLLS ONLY ONCE AND MOVES A TOKEN OUT OF THE START BOX. ON THE PLAYER'S SECOND TURN THE OTHER TOKEN IS MOVED OUT ON TO THE PLAYING FIELD. FROM THEN ON EACH PLAYER HAS AT LEAST TWO ROLLS OF THE DICE, UNLESS OTHERWISE DIRECTED.

TO FIGURE 10B

FIG. 10A

FROM FIG. 10A

THROWING DOUBLES OR LANDING ON AN "E" (EXTRA ROLL) ADD DICE ROLLS PER TURN. YOU ARE ALLOWED TO CHOOSE WHICH TOKEN YOU WISH TO MOVE AFTER YOUR FIRST ROLL. THEN MOVE THE OTHER TOKEN ON THE NEXT ROLL. WHEN YOU HAVE RETURNED ONE TOKEN TO THE START BOX YOU ARE STILL ALLOWED 2 DICE ROLLS PER TURN TO MOVE YOUR REMAINING TOKEN.

ON YOUR TRAVELS TO AND FROM THE TREASURY YOU WILL BE ABLE TO PURCHASE PROFESSIONAL RIGHTS FOR CONSULTANTS, BROKER , PROFESSOR, REAL ESTATE OWNER, DOCTOR, LAWYER AND INDIAN CHIEF. YOU MAY PURCHASE AS MANY RIGHTS AS YOU CAN BEFORE YOUR OPPONENT AND BE ISSUED A FEE CARD FOR THE RIGHTS YOU BOUGHT. ONLY ONE PLAYER WILL OBTAIN THE RIGHTS FOR EACH OF THE PROFESSIONS AND HE OR SHE DOES SO WHEN THEY LAND ON THE PROFESSIONAL SYMBOL MARKED WITH A 1. THEY CANNOT BUY THE RIGHTS IF THEY LAND ON ANOTHER SIMILAR SYMBOL. IT MUST BE MARKED NUMBER 1 FOR PURCHASE.

WHEN YOU DO LAND ON A PROFESSIONAL SYMBOL AND NO ONE HAS THE RIGHTS AND YOU DO NOT WISH OR CANNOT PURCHASE, YOU PAY A LANDING FEE TO THE BANK. SEE FEE SCHEDULE CARDS. HOWEVER, UNTIL THE PROFESSION IS OWNED YOU PAY THE BANK ONLY 1/10TH OF THE LISTED FEE.

NOW WHEN YOU GET UP TO THE HIGHEST ROW YOU NEED TO ENTER THE FIRST TREASURY GATE ( MARKED WITH AN ARROW ) YOU CAN BUT YOU MUST THROW THE EXACT DICE PIPS TO DO SO. E.G. IF YOU ARE 4 SQUARES AWAY FROM A GATE YOU NEED TO ROLL A 5 ( 4 SQUARES +THE ONE TO ENTER). SHOULD YOU ROLL A HIGHER NUMBER OF PIPS, YOU PASS THE GATE AND CONTINUE AROUND THE TREASURY ON THE 8TH ROW UNTIL YOU CAN ENTER A GATE. AFTER YOU COLLECT WHATEVER MONIES ARE IN THE TREASURY, YOU LEAVE ON YOUR NEXT ROLL BY THE SAME GATE; PLACE A RING ON YOUR TOKEN (IN GAME BOX) TO SHOW YOU ARE NOW MOVING COUNTERCLOCKWISE AND HEAD BACK TO TOTAL WEALTH.

WHEN YOU ENTER THE TREASURY YOU TAKE THE MONEY CARD WHICH IS THERE ( THE FIRST PLAYER IN GETS THE $50,000 CARD AND REPLACES THAT WITH THE NEXT LOWER TREASURY CARD ) AND PLACE THE NEXT LOWER CARD IN THE TREASURY FOR THE

TO FIGURE 10C

FIG. 10B

FROM FIG. 10B

A FINAL SYMBOL IS ◁R▷.THIS IS A REVERSE SYMBOL. IF YOUR TOKEN WAS HEADED CLOCKWISE AND YOU LANDED ON A ◁R▷YOU PLACE A RING ON THE TOKEN AND START BACK COUNTER-CLOCKWISE ON YOUR NEXT MOVE. IF YOU LATER LAND ON ANOTHER ◁R▷YOU REMOVE THE RING AND START BACK TOWARDS THE TREASURY. SHOULD YOU HAPPEN TO GET BACK TO YOUR START BOX WITH A TOKEN BEARING A RING ( BUT WITH NO TREASURY CARD FOR THAT TOKEN ) YOU DO NOT COLLECT ANY MONEY BUT SIMPLY TURN AROUND LOSING ANY EXTRA PIPS AND ON YOUR NEXT TURN HEAD BACK TO THE TREASURY. IF YOU HAVE BEEN TO THE TREASURY AND ARE RETURNING WHEN YOU HIT ◁R▷ YOU CAN CONTINUE BACK TO THE TREASURY FOR ANOTHER COLLECTION IF YOU GET THAT FAR. REMEMBER TO REMOVE THE RING IF YOU HEAD CLOCKWISE.

DOUBLES - DOUBLES GIVE YOU AN EXTRA ROLL. IF YOU ROLL A DOUBLE, YOU MOVE TO THE PROPER SQUARE AND COLLECT OR PAY BEFORE YOU ROLL AGAIN FOR THE DOUBLE.

O.K. WHAT ABOUT THE GOVERNOR, GOV?

WHEN ANOTHER HAS LANDED AND STOPS IN ONE OF YOUR TERRITORIES YOU MAY ATTEMPT TO LAND ON THE TOKEN AS FOLLOWS. AFTER YOUR TOKEN ROLLS ARE OVER YOU GET ONE ROLL OF ONE DIE TO SEE IF YOU CAN HIT THE TOKEN. IF YOU DO THE PLAYER PAYS YOU $10,000 FOR THE UPPER TERRITORY AND $5,000 IN THE LOWER TERRITORY. YOU PLACE THE TOKEN ONE SQUARE ON EITHER SIDE (YOUR CHOICE) OF THE SQUARE YOU HIT AND YOU PUT THE GOVERNOR WHERE THE TOKEN WAS.

THE GOVERNOR CAN MOVE UP, DOWN, SIDEWAYS OR EVEN UP, DOWN AND SIDEWAYS, ANY WAY YOU LIKE ( FOR INSTANCE OR ). E.G.

THE TOKEN IS NEXT TO GOV.
THE GOVERNOR ROLLS A 5.

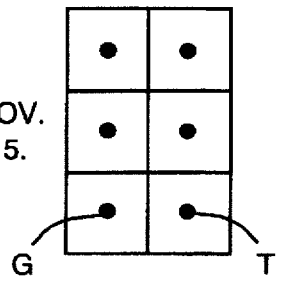

G. HITS T.

TO FIGURE 10D

FIG. 10C

FROM FIG. 10C

IF YOU MISS THE TOKEN, YOU CAN LAND ON ANY SQUARE EXCEPT AN OCCUPIED "S" ( SAFE FROM GOVERNOR) SQUARE. THE "G" WAITS THERE UNTIL YOUR NEXT TURN.

THE GOVERNOR DOES NOT GET THE BENEFIT OF ANY SYMBOL NOR IS THE GONERNOR PENALIZED; BUT CAN ONLY MOVE ABOUT IN THE TERRITORIES.

SHOULD A PLAYER LAND ON YOUR GOVERNOR THE PLAYER ELECTS WHICH SQUARE ON EITHER SIDE OF THE GOVERNOR TO PLACE THE TOKEN. HOWEVER, THE PLAYER STILL PAYS $10,000 OR $5,000 TO THE TERRITORY OWNER. SHOULD YOUR OWN TOKEN LAND ON YOUR OWN GOVERNOR, YOU ELECT WHICH SIDE TO PLACE THE TOKEN. YOU ARE NEVER PENALIZED IN YOUR OWN TERRITORIES BUT YOU CAN COLLECT.

WHEN A PLAYER RETURNS TO THE START BOX AND HAS IN POSSESSION A TREASURY CARD TO INDICATE SO, THE PLAYER RECEIVES A CASH AWARD OF VALUE PER THEIR PLACE IN RETURNING. THE FIRST PLAYER RETURNING RECEIVES THE HIGHEST AWARD OF $35,000.

THE CLERK AWARDS A RETURN CARD WHICH IS INCLUDED IN THE FINAL COUNT OF ASSETS.

THE AWARDS DECREASE IN VALUE AS EACH FOLLOWING PLAYER RETURNS. SEE CLERK.

WHEN A PLAYER HAS RETURNED ONE TOKEN TO THE START BOX - THE PLAYER CAN THEN DOUBLE THE PENALTY FOR GOVERNOR HITS IN THAT PLAYER'S TERRITORIES (I.E. A GOVERNOR STRIKING ANOTHER PLAYER'S TOKEN RECEIVES $20,000 AND $10,000 FOR UPPER TERRITORIES RESPECTIVELY ). WHEN THE PLAYER HAS RETURNED BOTH TOKENS, THE GOVERNOR CHARGES $30,000 AND $15,000 .

AFTER BOTH OF YOUR TOKENS HAVE COMPLETED THE ROUND TRIP TO THE TREASURY AND BACK, YOU CAN STILL COLLECT MONEY IN YOUR TERRITORIES WITH THE GOVERNOR AND YOUR PROFESSIONAL RIGHTS CARDS AS OTHER PLAYERS LAND THEREON. YOU STILL GET A TURN WITH YOUR GOVERNOR WHEN ANY PLAYER IS IN YOUR TERRITORY UNTIL THE LAST PLAYER TOKEN IS BACK.

P.S. IF YOU NEED TO BORROW MONEY TO PAY A PENALTY OR PURCHASE RIGHTS YOU CAN DO SO WITH THE BANK, BUT YOU

TO FIGURE 10E

FIG. 10D

FROM FIG. 10D

IF YOU DO NOT PAY THE BANK BACK BOTH PRINCIPAL AND INTEREST AFTER 5 TURNS THE INTEREST WILL JUMP TO 20%. THERE ARE 5 TURN COUNTING MARKERS (CHIPS) ISSUED WITH YOUR LOAD AND AN I.O.U. YOU RETURN ONE CHIP TO THE BANK AFTER EACH TURN. IF YOU STILL CANNOT REPAY THE LOAN THE BANK GIVES YOU BACK THE MARKERS AND YOU WILL THEN BE ACCESSED 10% MORE PENALTY OR 20% TOTAL INTEREST. (THE BANKER ATTACHES, WITH PAPER CLIPS, $ BILLS TO THE BANK'S COPY OF THE I.O.U. EQUAL TO THE LOAN VALUE FOR THE RECORDS).

P.P.S. IF ON YOUR RETURN TRIP YOU FIND YOU ARE AT OR APPROACHING A TOTAL WEALTH BOX NOT YOUR COLOR, YOU WILL MOVE YOUR TOKEN UP ONE ROW AND CONTINUE COUNTERCLOCKWISE STILL USING AVAILABLE PIPS. SHOULD THIS SITUATION OCCUR AGAIN, DO THE SAME THING.

GOOD LUCK! STRATEGY WITH THE GOVERNOR WILL ALTER THE OUTCOME! ALSO, GOOD FORTUNE HELPS.

OPTION OR VARIATION:

WHEN ALL PLAYERS RETURN TO TOTAL WEALTH AND BEFORE THE $ ASSET COUNT IS STARTED, THE FIRST PLAYER BACK HOLDING THE $35,000 RETURN CARD HAS THE OPTION OF REQUIRING EACH PLAYER ( INCLUDING HER OR HIMSELF ) TO MAKE ONE MORE ROUND TRIP TO THE TREASURY AND BACK WITH ONE TOKEN (EACH ) BEFORE FINAL COUNT.

THE PLAYERS STILL GET TWO ROLLS OF THE DICE PER TURN, ETC.

MORE THAN 4 PLAYERS-

IF ANOTHER PERSON WISHES TO PLAY, ROLL THE DICE: THE TWO WITH THE LOWEST ROLLS BECOME PARTNERS. EACH PARTNER MOVES ONE TOKEN FOR THE TEAM WITH ONE ROLL OF THE DICE DURING THE TURN. THEY ALTERNATE FOR THE GOVERNOR MOVES.

AT GAME END THEY ADD TOGETHER THE TEAM $ & ASSETS TO DETERMINE THE TEAM WEALTH. THE TEAM GETS $50,115 TO START. NO MORE!

WITH THIS METHOD, UP TO EIGHT PEOPLE CAN PLAY. WITH TWO BOARDS, 16 COULD PLAY. LET'S HAVE A SLUMBER PARTY WITH PRIZES!

TO FIGURE 10F

FIG. 10E

FROM FIG. 10E

© 1994 FREDRICK D. MILLER

RING ON TOKEN INDICATES MOVEMENT COUNTER-CLOCKWISE

PLACE GOV. BUST ON TOKENS TO DESIGNATE GOVERNERS

FOOTNOTE-

* WHEN YOU REPLACE A TREASURY CARD, PLACE THE NEW CARD IN THE SAME POSITION AS THE LAST ONE, I.E. SAME COLOR ARROWS OVER SAME COLOR ARROWS

PLUS
+
+
SELECTED AS STAR FOR $10,000
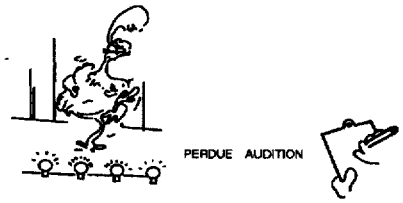
+
CHIEF RECEIVES $6,000
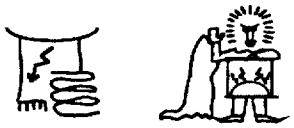
BLANKET CONTRACT WITH OUTLET
+
FINALLY FOUND A NUGGET !!!
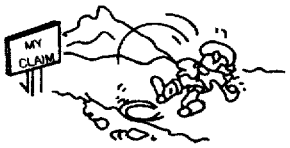
GET $7,000 AT ASSAY OFFICE
+
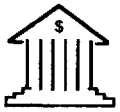
BANK INTEREST $360
+
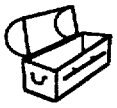
WON CASKET FOR FUTURE USE
VALUE $3,200
COLLECT THEN PAY RE $625
NEED PLOT
+
JOB CHANGE INCREASED SALARY
BONUS $5.000
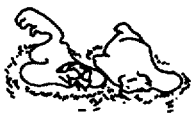
DID YOU EVER WISH TO START
YOUR DAY WITH SOMETHING
DIFFERENT THAN
COCKLE DOODLE DO?
FIG. 15B

UNKNOWN &
OPTIONS

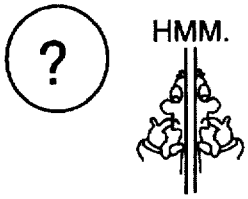

OPTION:

YOU MAY GO TO THE START BOX AND REMAIN THERE OR GO TO THE TREASURY AND START BACK COUNTERCLOCKWISE ON YOUR NEXT ROLL

OPTION:

IF YOU WISH YOU MAY CHANGE DIRECTION OF ONE TOKEN

?

YOU'RE IN BAD SHAPE!
GO TO MD 4.
HEALTH IS EXPENSIVE

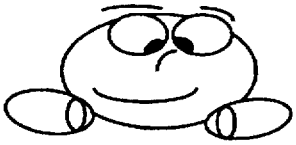

?
MOVE 2 ROWS DOWN AND MOVE 1 SQUARE COUNTER-CLOCKWISE

?
GO TO AND ENTER TREASURY DIRECTLY AT GREEN GATE! COLLECT BONUS EVEN IF WRONG COLOR.

?
RETURN ONE TOKEN TO TOTAL WEALTH FOR NEW ONE TOKEN START

FIG. 15C

STOCKS,
BONDS,
C.D.S
PURCHASE STOCK "D"
PAY $3,000
KEEP CARD
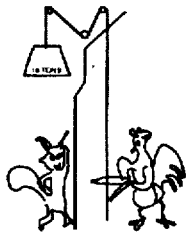
FOILED COMPETITOR
AWARDED $8,000
RISK $1,000
ROLL THE DICE
RETURN IS $1,000 TIMES THE DICE
PIPS SHOWN
LOW STOCK YIELDS
DIVIDEND $20
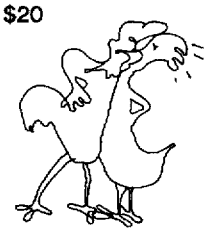
NO MORE BINGO WITH THE CORN!
UTILITY COMPANY BONDS
COLLECT $450
STOCK DIVIDENDS
COLLECT
$630
FIG. 15E

OS-RICH

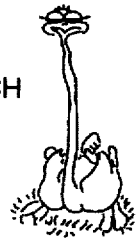

FLIGHT TICKET - $325

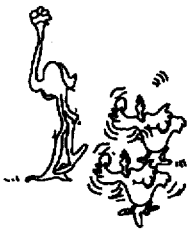

WENT TO KANSAS

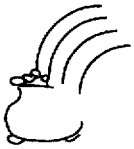

DISCOVERED THE POT
$25,000 FROM BANK

PROF COMES UP W/ NEW MATH
PROF COLLECTS $3,350 FROM BANK

PP X I TO THE 10TH POWER = C
PP= PURCHASE PRICE
I = INTEREST

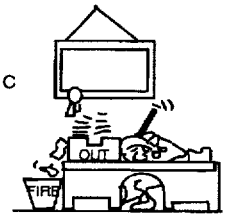

INCREASE IN TAXES FOR ARMED FORCES

PAY $2,000

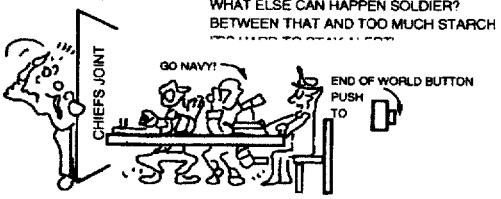

SIR, CAMPS X,Y,Z ARE OUT OF T.P.

CONSULTANT CONSULTS CONSULTANT

ADVISED TO QUIT
CONSULTANT MUST TURN CARD TO BANK
(NO REFUND)

GIVE THIS CARD TO ANY PLAYER
YOU WISH -
THEY PAY A PENALTY OF $40,000
TO YOU FOR NOT BEING COURTEOUS
ENOUGH!

FIG. 15F

" I " INHERIT

GRAND ESTATE, WELL PLANNED!

YOUR SHARE= $45.000

ESTATE PROCEEDS AFTER ALL EXPENSES = $38,000

COLLECT FROM BANK

FIG. 15G

BOARD GAME

BACKGROUND OF THE INVENTION

The present invention relates to a board game and, more particularly, to a game board and methods of playing same. Numerous games have been provided in the prior art that are adapted to be played with skill and are also games of chance. While these devices may be suitable for the particular purposes to which they address, they would not be suitable for the purpose of the present invention as hereinafter described.

SUMMARY OF THE INVENTION

Accordingly, it is a primary object of this invention to provide a game in which a plurality of players are provided an opportunity to both earn and lose wealth, with the wealthiest player at game's end being deemed the winner. Play is accomplished by each player in turn advancing his or her two designated play tokens from an initial outside corner of a game board to the center of said game board and then moving back to said initial outside corner of the game board. Each play token is moved clockwise following a path, along square rows, around said game board from row one to row eight until the play token enters said center of said game board, referred to as the center finish box at which time said player is awarded a prize. Said play token which enters said center finish box is then required to move back along said path in the same manner but in a counterclockwise direction from row eight to row one until said play token which entered said center finish box reenters said player's initial outside corner. Dice are rolled and the resulting number determines how many squares a play token is to be moved. Each play token is further advanced or penalized immediately based upon directions contained within a symbol square upon which the play token has landed.

Another object of the present invention is to provide a game in which each player also controls at least one territorial token. The territorial token must remain within designated boundaries on the game board and is moved a number of squares determined by a roll of the dice, said territorial token can be moved in any direction or combination of directions. The purpose of the territorial token is to land upon another player's play token thereby entitling the player controlling said territorial token to exact a penalty on the player upon whose play token said territorial token has landed.

It is another object of this invention to provide a game in which a plurality of players are given further opportunities to gain wealth by purchasing rights entitling a rights purchasing player to collect fees from other players under specified conditions or upon the occurrence of certain events.

It is another object of this invention to provide a game suitable for persons of all ages, playable by a plurality of persons in which although there exist elements of chance, there are also substantial elements of skill.

It is still another object of this invention to provide a game which emphasizes and utilizes the skill of strategy to enable each player to develop and accomplish offensive and defensive objectives.

It is yet another object of this invention to provide a board game which is challenging and exciting to play.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings wherein:

FIG. 8 is a pictorial view of a "cue card" which is provided to each player;

FIG. 9 is a pictorial view of a "reminder chart" which describes symbols and rules;

FIGS. 15*a* through 15*g* is a pictorial view of a sampling of specific cards selected from the FIG. 14 subject cards.

DETAILED DESCRIPTION OF THE PREFERRED EMBODIMENT

Figure 1:
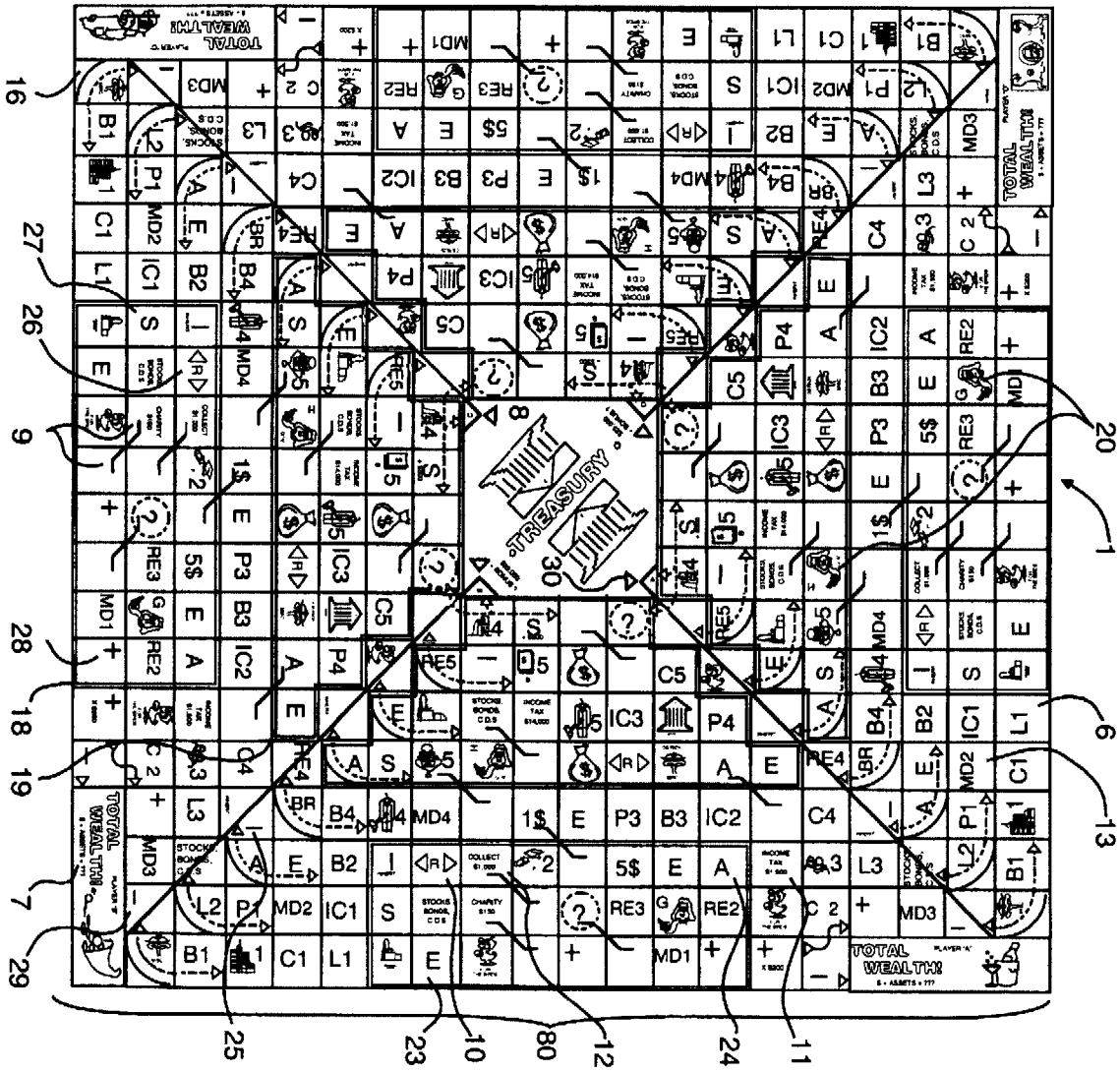
FIG. 1 is a plan view of a game board of the game apparatus constructed in accordance with the present invention.
Figure 2:
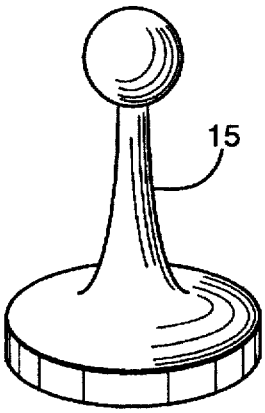
FIG. 2 is a pictorial view of the tokens for use by a player of the game apparatus of FIG. 1.
Figure 3:
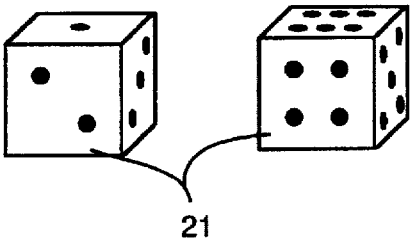
FIG. 3 is a pictorial view of two move determining devices of the game apparatus of FIG. 1.
Figure 11:
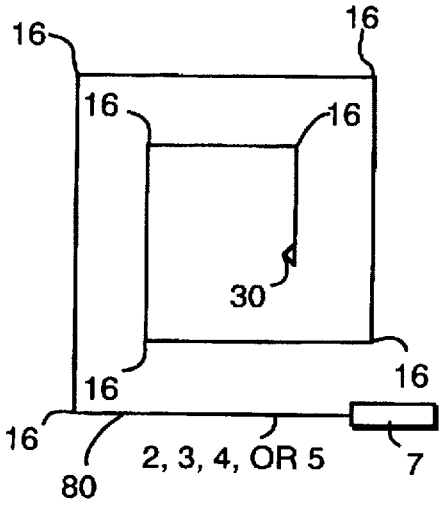
FIG. 11 depicts the configuration of each path as viewed from the base row.
Figure 12:
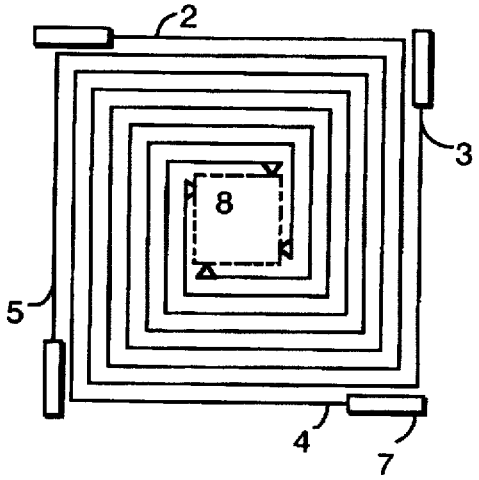
FIG. 12 depicts the configuration of all four paths when superimposed onto the FIG. 1 game board.

Referring now to the drawings and more particularly to FIG. 1, a preferred embodiment of a game board is depicted. The game board 1 is to be constructed of a material possessing sufficient rigidity so as to accomodate its use as a game board with placement and movement of pieces thereon. Four continuous playing paths, best depicted on FIG. 12, referred to generally by the numerals 2, 3, 4, and 5, are provided on the surface of game board 1. Game board 1 is divided into twenty by twenty grid squares 6 forming a larger square containing a total of four hundred grid squares 6. Playing paths 2, 3, 4, and 5 are divided into three hundred and sixty eight grid squares 6, comprising the play area. Each of paths 2, 3, 4, and 5 contain ninety two adjacent grid squares 6 and seven ninety-degree corners 16, which form an eight-sided figure. The plurality of grid squares 6 comprising each playing path define and form a plurality of continuous rows which delineate allowable movements of each player of said plurality of players through the playing paths 2, 3, 4, and 5. Specifically, each playing path starts at a start box 7 designated at one outside corner of game board 1 and each playing path spirals inward to a center finish box 8 of the game board. Center finish box 8 comprises sixteen grid squares 6 and each start box comprises four grid squares 6. Each of paths 2, 3, 4, and 5 contain ninety two adjacent grid squares 6, seven of which are further defined as ninety-degree corners. This structure results in playing paths 2, 3, 4 and 5 being arranged into a decreasing helical pattern, each of said playing paths offset from the others by 90 degrees, as shown in FIGS. 11 and 12. It is preferred that each grid square 6 be uniformly square further having its four sides aligned with one side of a contiguous grid square. The term "contiguous grid square" is defined for all purposes herein as two or more grid squares which are in contact, either horizontally, vertically or diagonally, with each other. Such an arrangement allows each grid square to come in contact with a plurality of other grid squares, creating uniformity in the playing paths. As can be seen from FIG. 1, each quadrant formed by diagonally dividing game board 1 from one corner to its diagonally opposite corner, intersecting the game board centerpoint is identical, with the exception of a color specifically designated for each quadrant, graphics depicted within said start box 7 and within said center finish box 8 in the center of game board 1.

As shown in FIG. 1, the general arrangement of the game board is as follows. A base row 80 comprising nineteen adjacent grid squares 6 (four startup squares and fifteen squares of the playing path) running parallel to an edge of the board game begins in a clockwise manner at each of the four different corner grid squares of the board. Row two begins directly adjacent to and vertically above the last grid square (grid square nineteen) of base row 80 at a ninety degree angle from the base row forming a first corner. Row two extends seventeen squares to a next corner where row three begins at a grid square directly adjacent to and to the right of the last grid square of of row two. Row three contains fifteen grid squares (two less squares than row two). Each row thereafter up to row eight is two grid squares less than the previous rowhaving corners formed at all turns made. This configuration results in the aforementioned decreasing helical pattern comprising a square path of eight sides (rows) and seven corners, see FIG. 11. The last grid square 6 (grid square ninety-two) intersects at ninety degrees to center finish box 8 which further comprises an eighth corner.

At least a portion of the grid squares 6 are illustrated with a first plurality of indicia. The indicia instruct a player landing thereon to perform some function. Certain of grid squares 6 bearing said first plurality of indicia define and form crossover zones 9 which allow movement by the players from one playing path to another. For purposes of identification, each crossover zone 9 is depicted with a line leading from a first grid square 6 to a next grid square 6 thereby marking the allowable movement of the players therethrough. Certain others of grid squares 6 bearing said first plurality of indicia define and form reverse direction squares 10 which require the player to reverse direction on playing path 2, 3, 4 or 5 from clockwise to counterclockwise or vice versa. Still others of grid squares 6 bearing said first plurality of indicia define penalty squares 11, reward squares 12 and profession squares 13. Each of squares 11 and 12 require the player to follow instructions set forth on said square, either penalizing indicia or rewarding indicia based upon the nature of said square.

Figure 7:
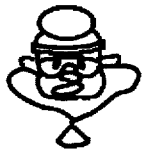
FIG. 7 is a pictorial view of a representative "professional card" giving the player in possession of such card additional rights.
Figure 10F:
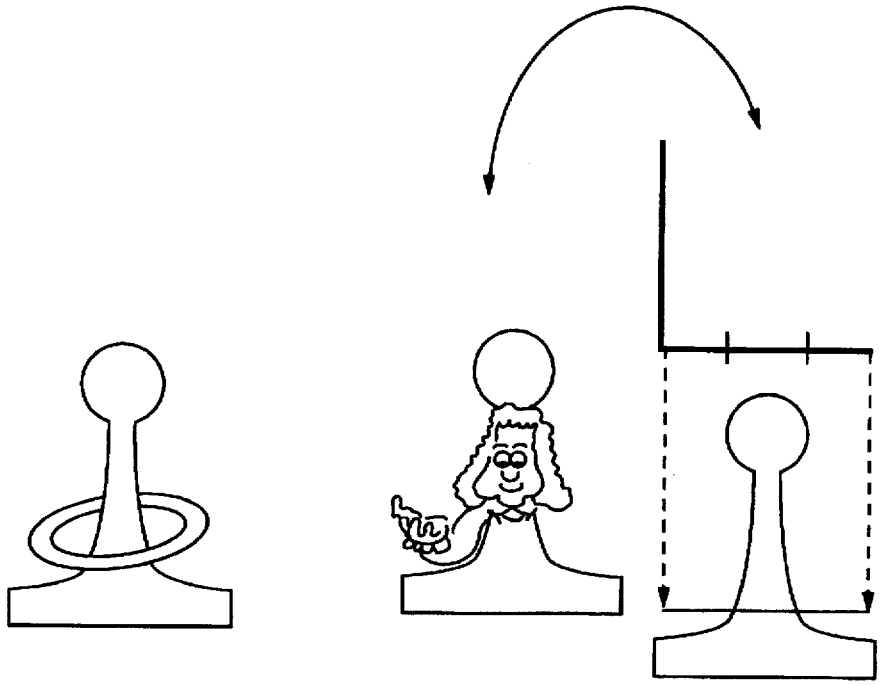
FIG. 10 is a pictorial view of a "Rules of the Game" card.

Profession squares 13 are apportioned to a multiplicity of individual professions. In preferred embodiments, these professions are professor, broker, doctor, indian chief, consultant, lawyer, and real estate owner, however other designations would be acceptable and would not affect game play. Each individual profession selected from the multiplicity of professions is further subdivided into a series of numerical levels. Each numerical level selected from the series of numerical levels corresponds to an individual grid square 6 on each playing path 2, 3, 4 or 5, wherein said grid square corresponds to a specific instruction designated on a profession card 14 as depicted in FIG. 7. For example, the subgroup comprising the doctor profession is further subdivided into levels one through five, each of these levels one through five has a specific grid square 6, at least one located on each playing path 2, 3, 4, and 5 for which it corresponds. During play of said game, a player landing on level one of the doctor profession (or level one for any other enumerated profession) would consult profession card 14 corresponding to the doctor profession and pay a penalty designated for level one of said profession, in this case "$250 FOR WAITING"

However, the first player to land on level one, in turn, for each of said professions may alternatively opt to purchase rights in said profession by paying a price designated on each specific profession card 14 under that section of said profession card pertaining to purchasing rights.

In the case of the doctor card, "$40,000". Any other player subsequently landing upon a grid square 6 pertaining to a profession to which purchasing rights have been gained by any other player would pay a penalty to the purchasing player as designated on said profession card 14.

Figure 4:
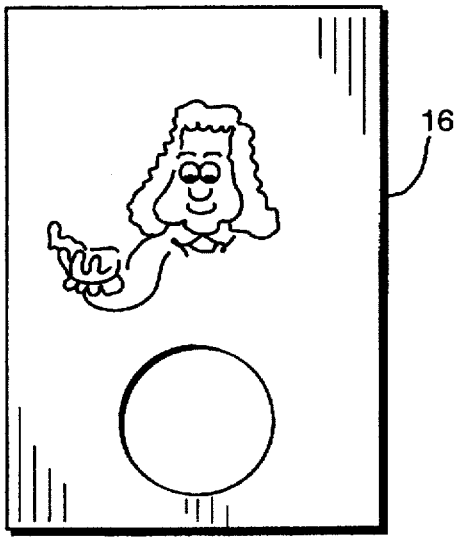
FIG. 4 is a pictorial view of a bust which is placed over one of the tokens of FIG. 2 thereby transforming a play token into a territorial token.
Figure 13:
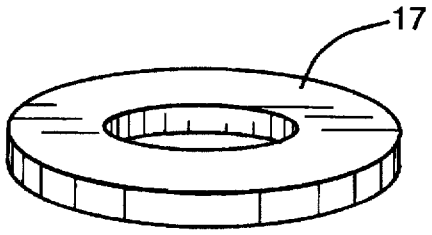
FIG. 13 depicts a ring to be placed over a game token to signify that said token is proceeding in a counter-clockwise direction.

A plurality of tokens 15 are provided for indicating movement of each player through playing paths 2, 3, 4 and 5. These tokens 15 should be distinctively colored to be indicative of each individual player. Each player controls four tokens 15, all of the same color. A first two of said tokens are designated as play tokens, and comprise a first subgroup. The remaining two tokens 15 are designated as territorial tokens, comprising a second subgroup, and a bust 16, depicted in FIG. 4, is placed over each of said tokens 15 to distinguish them from the first two tokens. The play tokens without bust 16 are moved along playing paths 2, 3, 4, or 5. Play tokens are moved in a clockwise direction from start box 7 along one of playing paths 2, 3, 4, or 5 until said token reaches center finish box 8 in the center of game board 1, at which time the specific play token which entered center finish box 8 then reverses its direction and proceeds back to its start box 7. To designate in which direction a play token is moving (i.e., clockwise or counterclockwise), a ring 17 as depicted in FIG. 13, or similar designator means is placed over play token when said play token is moving in a counterclockwise direction back toward start box 7.

Additionally two areas bearing a second plurality of indicia comprising a multiplicity of contiguous grid squares 6, or distinctive groups are located in each quadrant. These areas designate territorial zones and each territorial zone is occupied by one of each of two remaining tokens 15, designated as the player's territorial tokens. Each player's territorial zones 18 and 19 are located in the same quadrant as said player's start box 7 which is located at the outside right hand corner of said quadrant. A first zone 18 comprises a rectangular region eight grid squares long by three grid squares deep whereas a second zone 19 comprises a trapezoidal region four grid squares long at a short length and increasing by two grid squares each row for a total of four rows comprising a length of ten grid squares at a long length. One of each player's territorial tokens is placed upon a predesignated starting grid square 20 in each of said player's territorial zones 18 and 19. From that moment on, when any other player lands upon a grid square 6 which is located within any other player's territorial zone 18 or 19, the player controlling said territorial zone may exact a toll from said trespassing player; if said controlling player can, by proper roll of dice 21, land territorial token upon the same grid square 6 occupied by the trespassing player. Movement of territorial tokens unlike play tokens are not constrained by movement along playing paths 2, 3, 4, or 5. Each territorial token can move in any vertical, horizontal or combination of either direction so long as said token does not exit its designated territorial zone 18 or 19 specifically. Furthermore, territorial tokens ignore any instructions contained upon any grid squares 6 designated as squares 11 or 12. Such instructions are only for use of the play tokens.

OBJECT OF THE GAME

Figure 14:
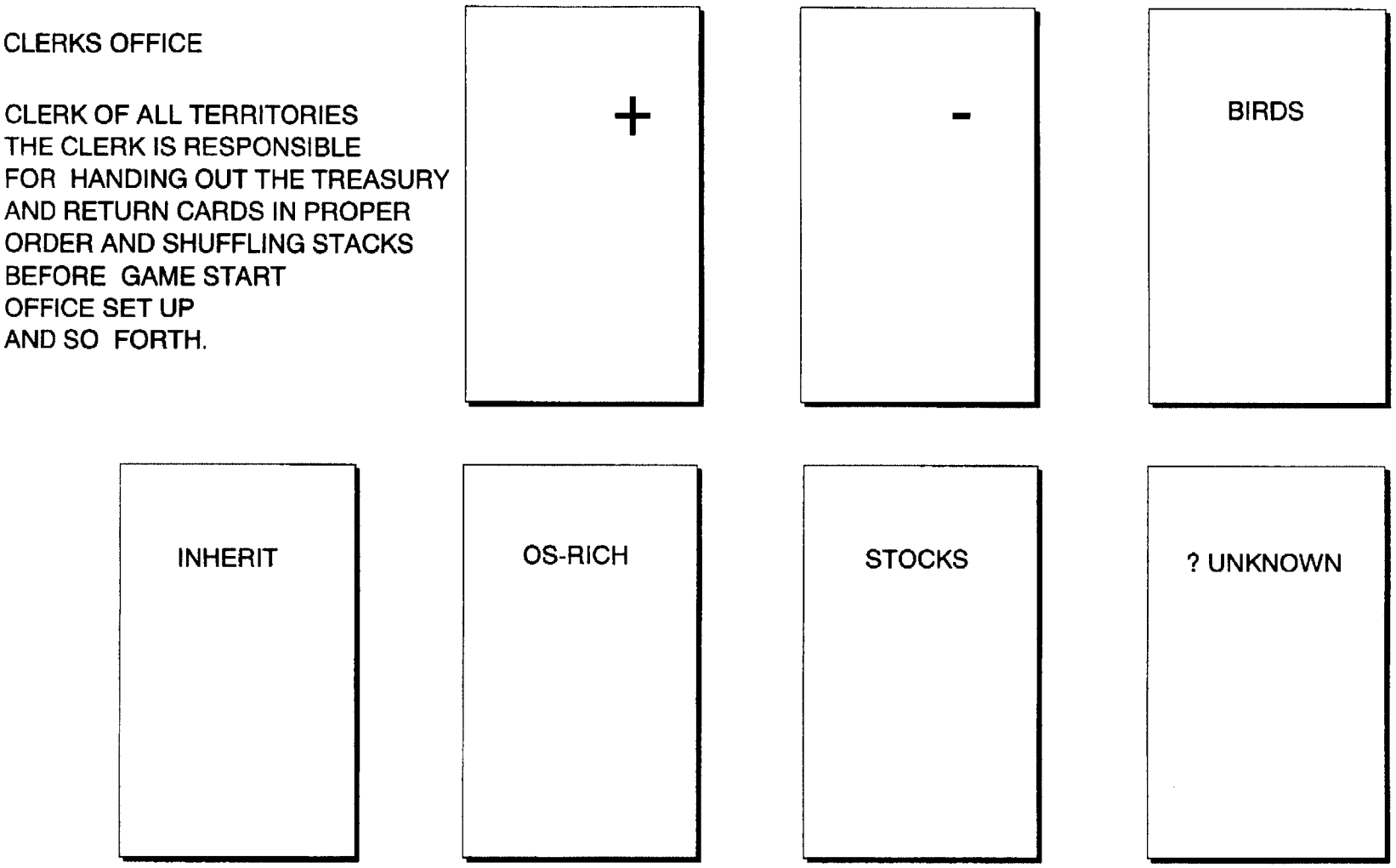
FIG. 14 is a pictorial view of a plurality of subject cards used in the game.
Figure 15A:
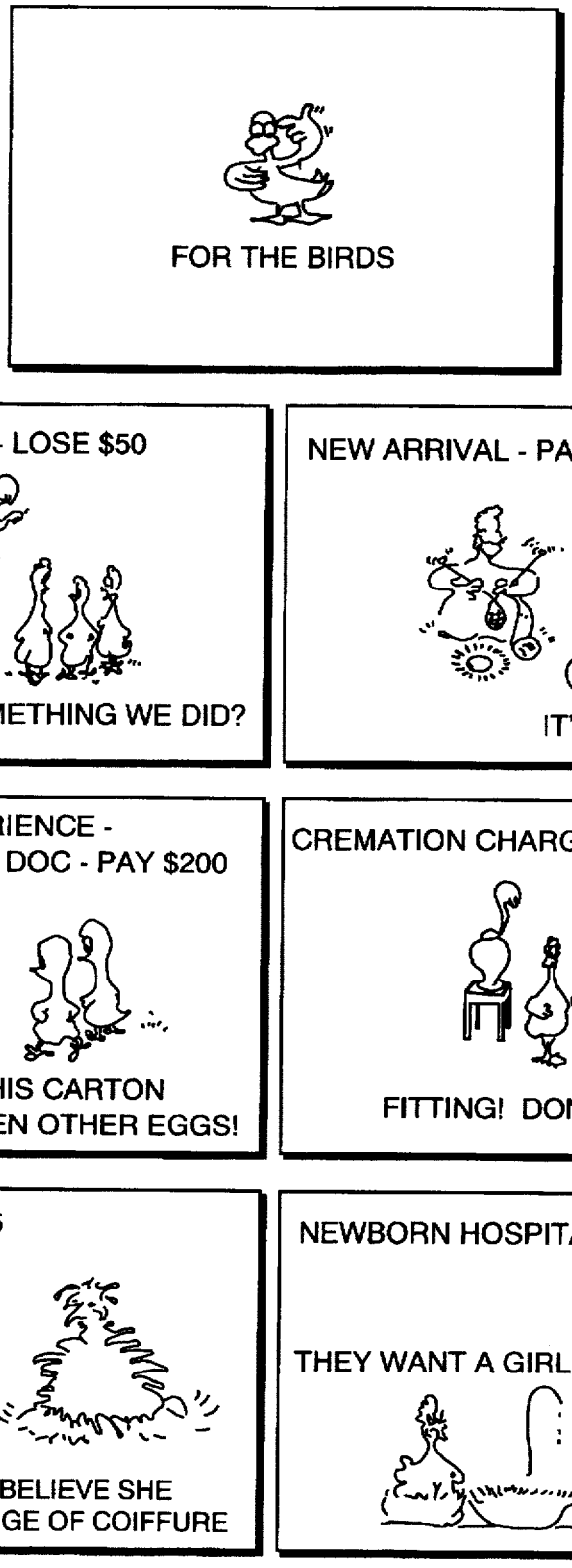
Figure 15D:
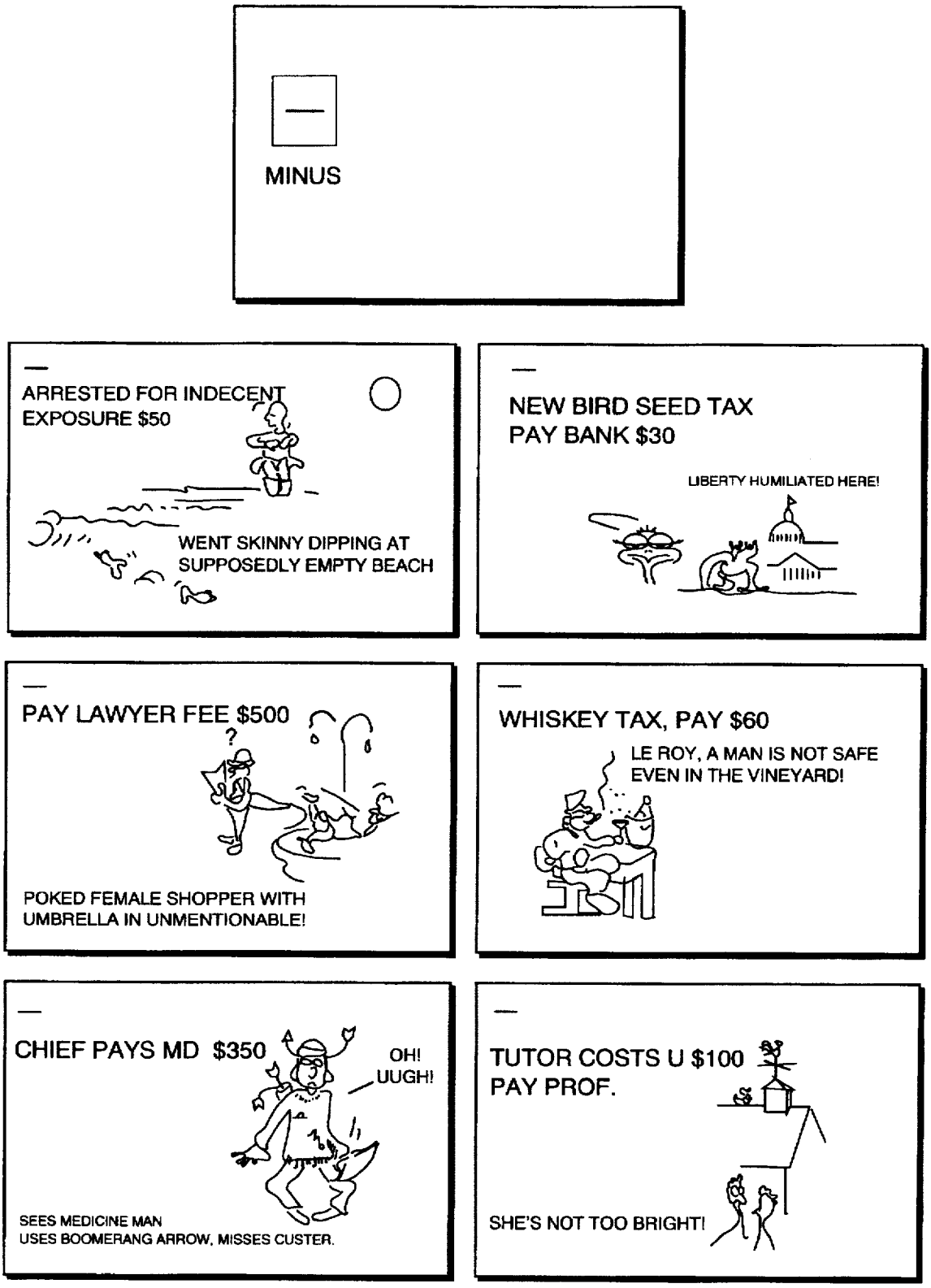

The object of the game is to be the player with the highest total wealth at the end of the game. The game ends when all players move both of their play tokens from their start box 7 to the center finish box 8 in the center of the game board marked "TREASURY" and back to their start box 7. Along the way, each player has the opportunity to earn and lose wealth by following the directions of the grid square upon which his or her play token lands, following the directions upon a card picked from a plurality of by the player (a sampling of which are depicted in FIGS. 14 through 15*g*), or earning or paying money as a result of a player's play token landing on either; a profession 13, or territorial 18 and 19 grid square.

THE GAME

The game is begun by the players (two, three, or four for individual play; or multiples of two, three or four for team play) selecting their token color. Representative token colors can be green, red, yellow and blue; although other colors and combinations of the foregoing may be used. Each player places a label, over two of the four tokens 15. In the preferred embodiment said label is a cardboard or plastic bust 16. Once done, said tokens are now known as territorial tokens, said tokens are placed upon "GOVERNOR" grid squares 20 (designated by either a label, a graphic, or both) one within each territorial zone 18 and 19 corresponding to that individual player's color. The two remaining tokens (without busts 16) are placed within that player's start box 7 corresponding to that player's color and are designated play tokens.

A predetermined quantity of "play" dollars are distributed to each player and one player is selected to begin the game by a suitable means such as the player rolling the highest value on dice 21 begins the game. The tokens are moved pursuant to the roll of dice 21. The first player rolls dice 21 and moves one of the play tokens the requisite number of grid squares 6 along that players playing path 2, 3, 4 or 5. This pattern continues in a clockwise pattern until all players have had a turn, this constitutes a round of play. After completion of the first round, the first player again rolls dice 21 and moves his other play token the requisite number of grid squares 6 along his playing path. Play continues in the same manner as the first round except each player moves his or her second play token. On the third and all subsequent rounds, each player rolls the dice and selects which play token to move the requisite number of squares, however then the player again rolls dice 21 and moves the other play token the requisite number of squares. Play continues in the same fashion for all other players. If the player rolls two of the same, i.e., doubles, said player is awarded an additional roll of dice 21 thereby allowing him to move that same play token an additional number of grid squares. If play token lands upon a grid square imprinted with an "E" 23, said play token is also awarded an additional roll of the dice.

During any round, the player must follow the instructions set out upon whichever grid square 6 that player's play token comes to rest upon prior to rolling dice 21 again. Instructions are symbolized by certain symbols emplaced within and/or without grid squares 6. The definition of these board symbols are shown in FIGS. 7, 8 and 9, and are more fully discussed as follows. In addition to profession squares 13, described above, a play token may land on grid squares containing one of the following designations; "A" 24, "E" 23, "T" 25, "R" 26, "S" 27, "+" 28, or "–" 29. If play token lands on a grid square 6 containing an "A" 24, said player advances said play token three squares. If play token lands on an "E" 23, said player is allowed an extra roll of dice 21 and said play token is advanced the requisite number of grid squares corresponding to the number rolled on said dice. If play token lands on an "T" 25, said player is awarded an inheritance set forth on a card drawn from an inheritance card pile. If play token lands on an "R" 26, said player reverses the direction in which said play token is advancing. If play token lands on an "S" 27, play token is safe from attack by a territorial token. If play token lands on a "+" or "–", player rolls dice 21 and either receives from bank (if a "+") or pays to the bank (if a "–"), an amount designated on said grid square multiplied by the number rolled on dice 21. If play token lands on a crossover zone 9, that play token advances diagonally one grid square and one row in the direction the play token was headed as depicted in FIG. 9. Crossover zones 9 serve only to advance play token, they never demote a play token's position on the game board. There are also zones designated on game board 1 which require the player to select a card from a specific pile, the specific pile determined by the type of grid space in which said player's play token has landed.

If a play token lands in another player's territorial zone 18 or 19, said player controlling territorial zone 18 or 19 rolls dice 21 and moves the territorial token occupying that territorial zone 18 or 19 a number of grid squares corresponding to the number designated on the dice. The intent is for territorial token to land by exact count in the same grid square 6 occupied by the other player's play token. The territorial token can move in any direction except diagonal but must remain within the specific territorial zone 18 or 19 which it occupies. If the territorial token can land on the play token, the player controlling the territorial token is awarded a predesignated fee from the player controlling the play token. Territorial tokens ignore all grid space instructions and therefore do not earn awards or pay fees. However, if a play token occupies an "S" 27 square within a territorial zone 18 or 19, that play token is safe from attack by a territorial token. In the event a play token actually lands upon a territorial token, the play token is moved to either side of said territorial token along the same playing path 2, 3, 4, or 5 which it was on. It is the player's choice as to which side of said territorial token said play token is moved. However, the player controlling the territorial token is awarded the predesignated fee automatically.

As stated above, to succeed in said game, each player must bring both of his or her play tokens to the center finish box 8 located at the center of the board and back to his or her start box 7 to successfully end that player's movement of play tokens. An exact roll on dice 21 is necessary to enter center finish box 8. In the event, the player does not roll the exact number to get in to center finish box 8, that play token continues to skirt around center finish box 8 along the eighth row ignoring individual play paths 2, 3, 4, and 5. Upon the next roll of dice 21, the player whose play token is skirting around center finish box 8 is given another chance and can enter at any entry point designated by arrow 30, so long as an exact roll on dice 21 is thrown. In the event the play token enters center finish box 8 on the first attempt by an exact roll, that player is awarded an additional bonus.

Figures 5, 6:
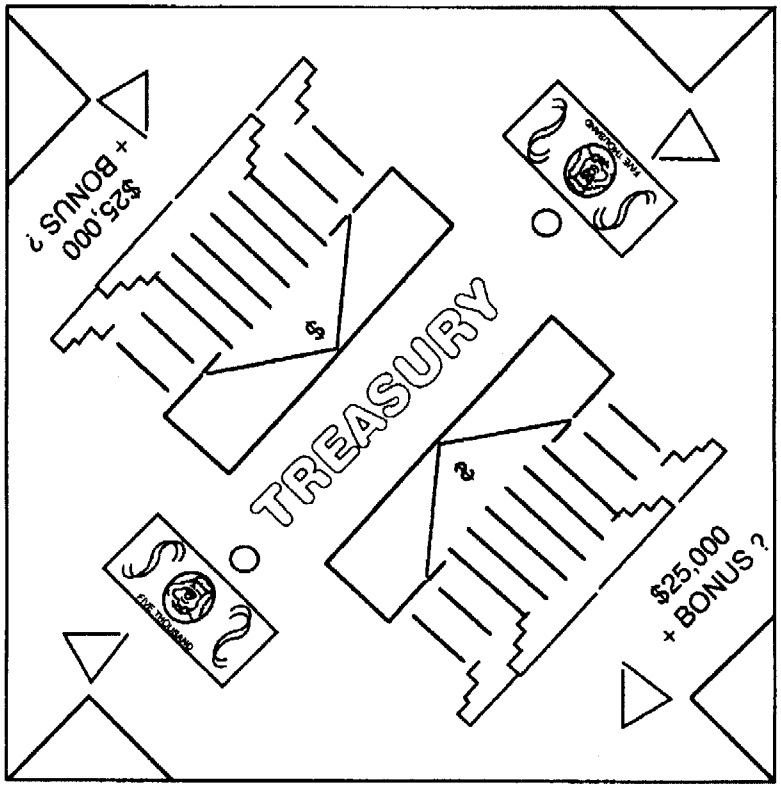
FIG. 5 is a pictorial view of a representative card given to each player upon entry to the center of the game board, referred to as the center finish box of the game apparatus of FIG. 1.
FIG. 6 is a pictorial view of a representative card given to each player upon reentry to said player's starting position of the game apparatus of FIG. 1.
Figure 16:
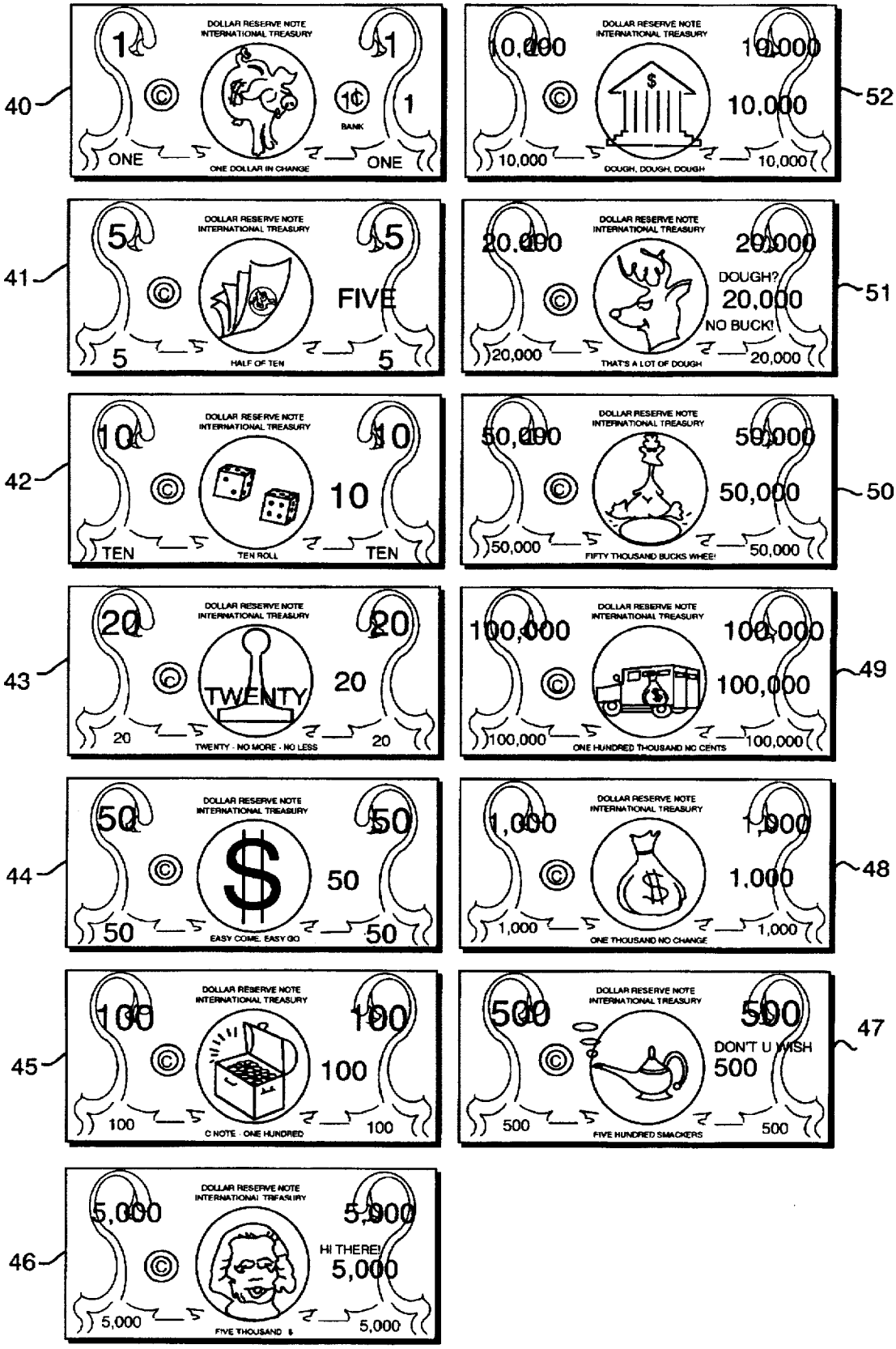
FIG. 16 depicts a preferred form of designating and tracking value in the FIG. 1 board game.

Each play token entering center finish box 8 is given a "TREASURY" card, depicted on FIG. 5, representing a quantity of "play" dollars. The "TREASURY" cards are turned into the bank when the play token which specifically earned said "TREASURY" card returns to the start box 7. "TREASURY" cards are awarded in a manner so that the first play token to enter center finish box 8 receives the highest value card and each card subsequently distributed is of a lesser value than the previous card. Players not having sufficient play money to cover the fees for which they may be responsible, can borrow money from the bank at a predesignated interest rate. One preferred form of said play money is depicted on FIG. 16 items 40 through 52. However, it should be noted that the values and artwork depicted on play money 40 through 52 is not necessary to game play and are considered ornamental designs.

The game time continues until each player brings both of his or her play tokens back to their start box 7, each play token possessing at least one "TREASURY" card signifying that each play token has actually reached center finish box 8 at least once. Players accomplishing this continue to collect fees to which they would otherwise be entitled from those players who have not finished.

STRATEGY

Because players are given an opportunity to select which of his or her two play tokens is moved by the first roll of dice 21, a player can elect to move the play token which he or she believes will provide the greatest immediate and future impact. Also control of professions greatly increase a player's capabilities to earn wealth. Proper selection of which expenses a player should borrow money against can provide the player an increased chance of return on the investment, thereby propelling the player into the lead. As players become more familiar with game play they also become better strategists.

While certain novel features of this invention have been shown and described and are pointed out in the annexed claims, it will be understood that various omissions, substitutions and changes in the forms and details of the device illustrated in its operation can be made by those skilled in the art without departing from the spirit of the invention.

I claim:

1. A game apparatus, comprising:

a plurality of distinctive groups of tokens, each group being indicative of one of a plurality of players, each group being further divided into a first subgroup and a second subgroup;

board means having a plurality of playing paths, said paths having a first and second end and being divided into a plurality of squares for indicating the movement of the players through said paths, each of said squares arranged upon said game board such that all squares form a grid pattern upon said game board, a contiguous sequentially arranged series of such squares further defining a plurality of inwardly spiraling playing paths, wherein said squares are suitably dimensioned for occupancy by said tokens, wherein at least some of said squares bear a first plurality of indicia comprising a plurality of penalizing indicia directing the player whose first subgroup token lands thereon to be penalized in some manner, and a plurality of rewarding indicia directing the player whose first subgroup token lands thereon to be rewarded in some manner; and wherein some of said squares form a second plurality of indicia comprising distinctive groups, each group being indicative of one of said players, said distinctive groups of squares forming zones in which said penalizing indicia do not effect the movement of said second subgroup of said tokens of the same distinctive group and wherein the movement of said second subgroup of said tokens is confined to said zone and further penalizes said first subgroup of said tokens if said second subgroup token lands upon said first subgroup token;

a plurality of distinct groups of subject cards each distinct group providing instructions as well as additional rewards or penalties which the player must follow; wherein said rewards further comprise both monetary rewards and movement advances for said first subgroup of said tokens, said penalties further comprise both monetary penalties and movement set-backs for said first subgroup of said tokens, and said instructions detail specific means to provide said rewards and penalties referenced upon said subject cards;

means for selecting by chance a number to determine the extent of movement of said tokens on said squares of said playing paths;

means for designating and tracking value of said rewards and penalties by awarding player's equivalent monetary value of said rewards and penalties in play money;

starting means, located at the first end of each of said paths, which determine the initial position of said first subgroup of said tokens; and finishing means, wherein said first subgroup of said tokens finish said game by first entering center of said gameboard therein gaining a card redeemable in said play money and returning with said card to said starting means, and wherein a winner is determined by said player possessing the greatest quantity of play money at games end after receiving play money for all assets and paying for all debts.

2. A game board apparatus as claimed in claim 1 wherein said second subgroup of tokens is distinguished from said first subgroup of tokens by placing a label onto said second subgroup.

3. A game board apparatus as claimed in claim 1 wherein at least a portion of said squares bearing a first plurality of indicia direct one of said player's first subgroup of said tokens landing thereon to select a card from one of said plurality of distinct groups of subject cards, and at least another portion of said squares bearing a first plurality of indicia direct a player to further subject said player's token selected from said first subgroup of said tokens to an additional instruction, wherein said instruction requires at least any one of; immediate movement of that token, a reversal of token movement direction, an additional manipulation of said means for determining the extent of movement of said tokens, a play money reward, a play money penalty;

wherein a further group of said squares bearing a first plurality of indicia indicate a plurality of professions, each of such profession squares being further categorized in that each such square exhibits a numeral selected from a finite number numerals, wherein the combination of said profession and said numeral specifically correlates to a monetary penalty listed upon a profession card corresponding to said profession requiring said player whose token selected from said first subgroup of said tokens lands thereon to pay said monetary penalty to the bearer of said card.

4. A game board apparatus as claimed in claim 3 wherein each of said profession cards also depict a purchase price enabling a player first landing upon that profession to opt to purchase said profession card and thereby be considered bearer of said card.

5. A game board apparatus as claimed in claim 3 wherein said numeral is any one of the numbers 1 through 5.

6. A game board apparatus as claimed in claim 5 wherein each of said playing paths is identical to any of the other playing paths with respect to quantity of squares contained therein and placement of specific first and second plurality of indicia thereon.

* * * * *